US007750721B2

(12) United States Patent
Ilkov et al.

(10) Patent No.: US 7,750,721 B2
(45) Date of Patent: Jul. 6, 2010

(54) REFERENCE CURRENT CIRCUIT AND LOW POWER BIAS CIRCUIT USING THE SAME

(75) Inventors: Nikolay Ilkov, Munich (DE); Udo Gerlach, Munich (DE)

(73) Assignee: Infineon Technologies AG, Neubiberg (DE)

( * ) Notice: Subject to any disclaimer, the term of this patent is extended or adjusted under 35 U.S.C. 154(b) by 51 days.

(21) Appl. No.: 12/100,808

(22) Filed: Apr. 10, 2008

(65) Prior Publication Data

US 2009/0256628 A1 Oct. 15, 2009

(51) Int. Cl.
*G05F 1/10* (2006.01)
*G05F 3/02* (2006.01)

(52) U.S. Cl. ..... 327/513; 327/538; 323/312; 323/315

(58) Field of Classification Search ..... 327/512, 327/513, 538; 323/311, 312, 315, 317
See application file for complete search history.

(56) References Cited

U.S. PATENT DOCUMENTS

| | | | | |
|---|---|---|---|---|
| 5,440,224 | A | 8/1995 | Kimura | |
| 5,627,461 | A | 5/1997 | Kimura | |
| 5,910,749 | A | 6/1999 | Kimura | |
| 5,990,727 | A | 11/1999 | Kimura | |
| 6,528,979 | B2 | 3/2003 | Kimura | |
| 7,026,860 | B1 * | 4/2006 | Gheorghiu et al. | 327/513 |
| 7,429,854 | B2 * | 9/2008 | Kimura | 323/315 |

* cited by examiner

*Primary Examiner*—Lincoln Donovan
*Assistant Examiner*—Patrick O'Neill
(74) *Attorney, Agent, or Firm*—Slater & Matsil, L.L.P.

(57) ABSTRACT

A reference current circuit has an input configured to receive an input current, a first transistor, a second transistor, and an output configured to provide a reference current. The input is directly connected to a control input of the second transistor and a first terminal of the first transistor, and is connected via a first resistor to a control input of the first transistor. The output is connected to a first terminal of the second transistor. A reference node is connected via a second resistor to the control input of the first transistor, directly to a second terminal of the first transistor and via a third resistor to a second terminal of the second transistor.

9 Claims, 4 Drawing Sheets

REFERENCE CURRENT CIRCUIT AND LOW POWER BIAS CIRCUIT USING THE SAME

BACKGROUND

Embodiments of the invention relate to a reference current circuit for providing a temperature compensated reference current.

Conventional bandgap circuits generate a reference current or a reference voltage by combining two voltage drops, the first voltage drop having a positive temperature coefficient and the second voltage drop having a negative temperature coefficient, so that the resulting reference current or reference voltage is substantially temperature independent. Such bandgap circuits may comprise bipolar transistors and the voltage drops are the base-emitter voltage drops (VBE). Such bandgap circuits may be used for providing to electronic devices a desired reference current or a desired reference voltage. The bandgap circuit may be provided as a separate circuit element or may be formed together with the electronic device. For example, the bandgap circuit may be formed using the SiGe:C (silicon germanium) technology. Implementing the bandgap circuit in this technology uses silicon germanium (SiGe) transistors having a characteristic base-emitter voltage drop (VBE) of about 0.8 V. Such bandgap circuits will not operate below 2V.

However, new trends in electronics and semiconductor technology may require further reduction in power consumption so that devices may be required to operate at voltages in the range below 2V, e.g., between 1V and 1.5V. The above described conventional bandgap circuits are designed to provide supply voltages down to 2V but not down to 1V to 1.5V so that a redesign of such conventional bandgap circuits would be required. For example, since bandgap circuits comprise series-connected BE-junctions, a semiconductor technology using silicon germanium transistors offers base-emitter voltage drops of around 0.8V. With two silicon germanium transistors connected in series a voltage drop of 1.6 V is applied to the circuit which requires supply voltages above at least 1.6V, in general above 2V. Thus, any redesign of such a conventional bandgap circuit would require a new design approach that uses different materials having, e.g., smaller bandgap voltages as silicon germanium. However, changing the technology is expensive and semiconductor materials with a smaller voltage drop may be very expensive in the manufacturing process.

SUMMARY OF THE INVENTION

Embodiments of the invention provide a reference current circuit for providing a temperature compensated reference current.

DETAILED DESCRIPTION OF ILLUSTRATIVE EMBODIMENTS

With reference to the accompanying figures embodiments of a reference current circuit and embodiments of a low power bias circuit using the same will be described.

As mentioned above, new trends to reduce the power consumption may require the design of a bias network able to operate at voltages as low as, e.g., 1V to 1.5V. There is a need to avoid a redesign of the conventional bandgap circuits and the associated problems of high expenses and difficulties when using different semiconductor materials with a smaller voltage drop. Therefore, embodiments of the invention relate to a reference current circuit which avoids series connected BE-junctions (as used in conventional bandgap circuits) thereby allowing good performance down to, e.g., 1V to 1.5V. Therefore, embodiments of the invention allow maintaining the semiconductor manufacturing technology, e.g., using silicon-germanium transistors, while changing the design of the circuit by using parallel base-emitter voltage drops instead of series base-emitter voltage drops. Embodiments of the invention offer a good supply rejection together with a good temperature stability. Embodiments of the invention provide a temperature-compensated voltage independent current source and low voltage low power bias networks. Such current sources or networks may be used for low noise amplifiers that operate at low power, for example for GPS (global positioning system) or DVB (digital video broadcast).

Figure 1:
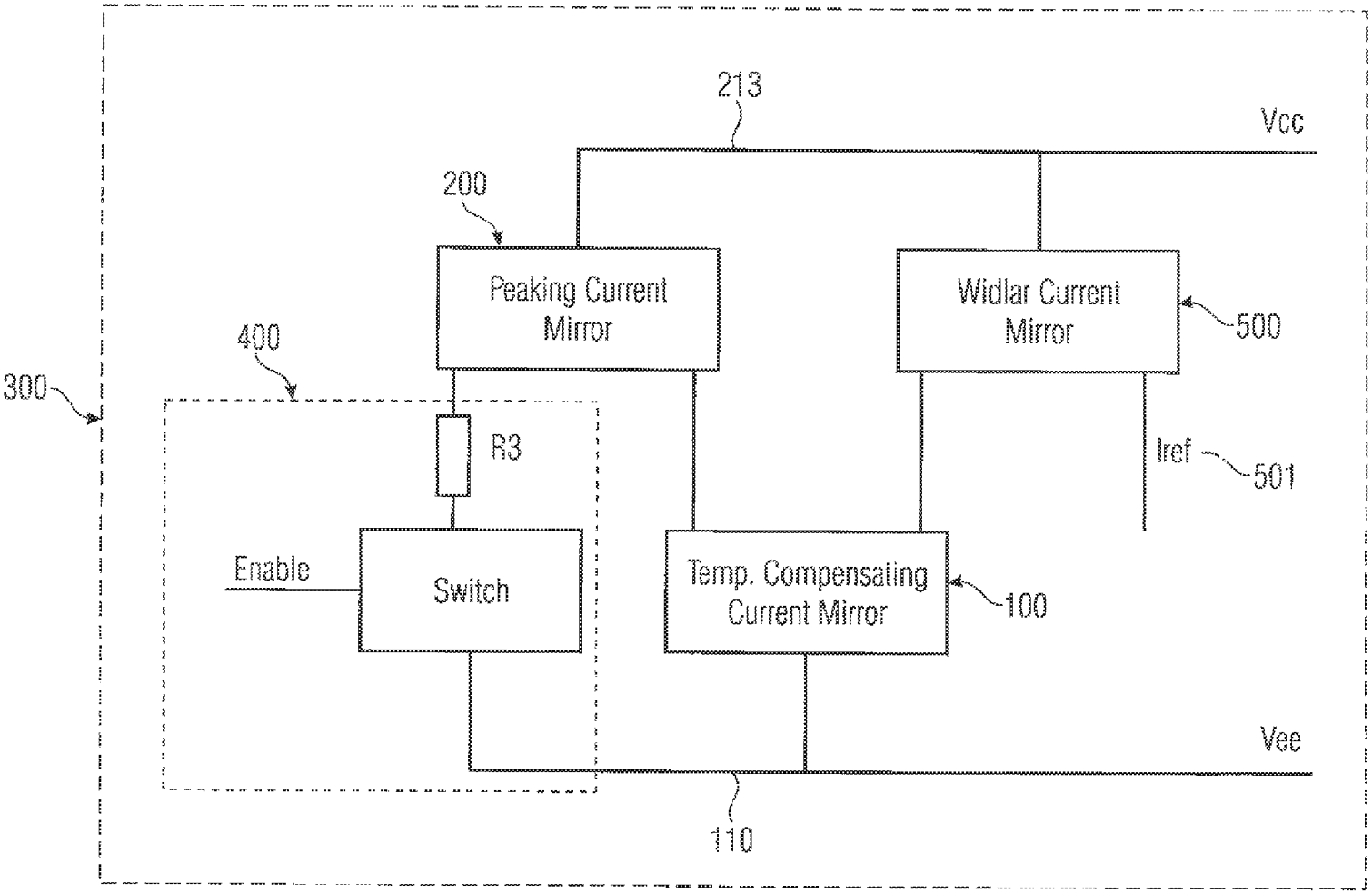
FIG. 1 shows a schematic block diagram of a low power bias circuit according to an embodiment of the invention.

FIG. 1 shows a schematic block diagram of a low power bias network comprising a reference current circuit according to an embodiment of the invention (see the temperature-compensating current mirror 100), a peaking current mirror 200, e.g., a Nagata current mirror, an optional enabling circuit 400, and an optional Widlar current mirror 500. The peaking current mirror 200 offers a good supply rejection but no temperature compensation and the temperature compensating current mirror 100 compensates for the temperature coefficient of the peaking current mirror 200.

Figure 2:
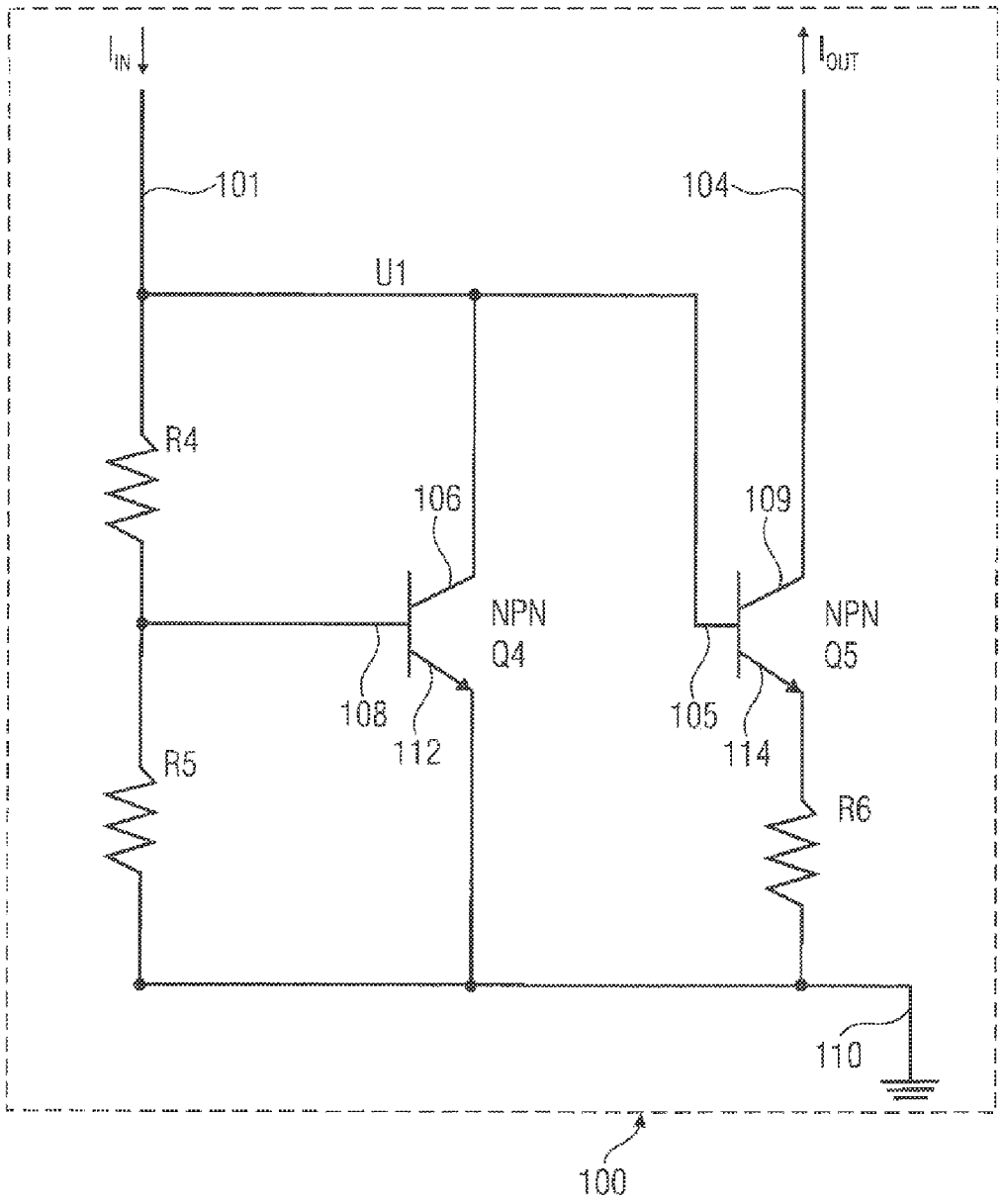
FIG. 2 shows a circuit diagram of a reference current circuit according to an embodiment of the invention.

FIG. 2 shows a circuit diagram of the reference current circuit 100 (temperature-compensating current mirror) shown in FIG. 1 according to an embodiment of the invention. The reference current circuit 100 comprises an input 101 configured to receive an input current Iin, a first NPN bipolar transistor Q4 and a second NPN bipolar transistor Q5 with an area ratio Q5/Q4=N, and an output 104 configured to provide a reference current Iout. The input 101 is directly connected to the base terminal 105 of the second NPN bipolar transistor Q5 and the collector terminal 106 of the first NPN bipolar transistor Q4. The input 101 is connected via a first resistor R4 to the base terminal 108 of the first NPN bipolar transistor Q4. The output 104 is connected to the collector terminal 109 of the second transistor Q5. The base terminal 108 of the first NPN bipolar transistor Q4 is connected to a reference potential 110, e.g., ground, via a second resistor R5. The emitter terminal 112 of the first NPN bipolar transistor Q4 is also connected to the reference potential 110, and the emitter terminal 114 of the second NPN bipolar transistor Q5 is connected to the reference potential 110 via a third resistor R6.

The input current Iin may have a temperature coefficient and the reference current circuit 100 is configured to compensate this temperature coefficient in order to provide a reference current Iout showing no temperature dependence. The input current Iin may be provided by a Widlar current mirror, a Nagata current mirror (see FIG. 1), a simple current mirror, a Wilson circuit, a cascode circuit, a current source with gain or by other current sources. The transistors Q4 and Q5 may be silicon germanium bipolar transistors with a base-emitter voltage drop of 0.8 V.

As can be seen from FIG. 2, the reference current circuit 100 comprises the two transistors Q4 and Q5 connected in parallel thereby avoiding the series connected BE-junctions as used in conventional bandgap circuits.

To compensate for the temperature dependency of the input current Iin the reference current circuit 100 is dimensioned as shown below. For the following calculations the currents that flow into the base terminals of the transistors are neglected. Further, ICQ4=collector current of Q4, ICQ5=collector current of Q5, ISQ4=saturation current of Q4, ISQ5=saturation current of Q5.follows:

For U1, neglecting the base currents:

$$U_1 = I_{R4,R5}(R4+R5) = \frac{V_{BEQ4}}{R5}(R4+R5) = \varphi_T \ln\left(\frac{I_{CQ4}}{I_{SQ4}}\right)\frac{1}{R5}(R4+R5).$$

But U1 also is:

$$U_1 = V_{BEQ5} + I_{CQ5}R6 = \varphi_T \ln\left(\frac{I_{CQ5}}{I_{SQ5}}\right) + I_{CQ5}R6$$

or $$\ln\left(\frac{I_{CQ4}}{I_{SQ4}}\right)\frac{R4+R5}{R5} = \ln\left(\frac{I_{CQ5}}{I_{SQ5}}\right) + \frac{I_{CQ5}R6}{\varphi_T}.$$

Differentiating both sides and assuming TCRs=0:

$$\frac{1}{I_{CQ4}}\frac{dI_{CQ4}}{dT}\frac{R4+R5}{R5} = \frac{1}{I_{CQ5}}\frac{dI_{CQ5}}{dT} + \frac{R6}{\varphi_T}\left(\frac{dI_{CQ5}}{dT} - \frac{I_{CQ5}}{T}\right).$$

For full temperature compensations $$\frac{dI_{CQ5}}{dT} = 0$$

and TCICQ3≈TCICQ4:

$$-\frac{R2}{R3}(V_{CC} - 0.8\text{ V}) = \frac{R5R6}{R4+R5}I_{CQ5}.$$

The calculated values may be used as a starting point for optimizing the circuit in a circuit simulator.

Figure 3:
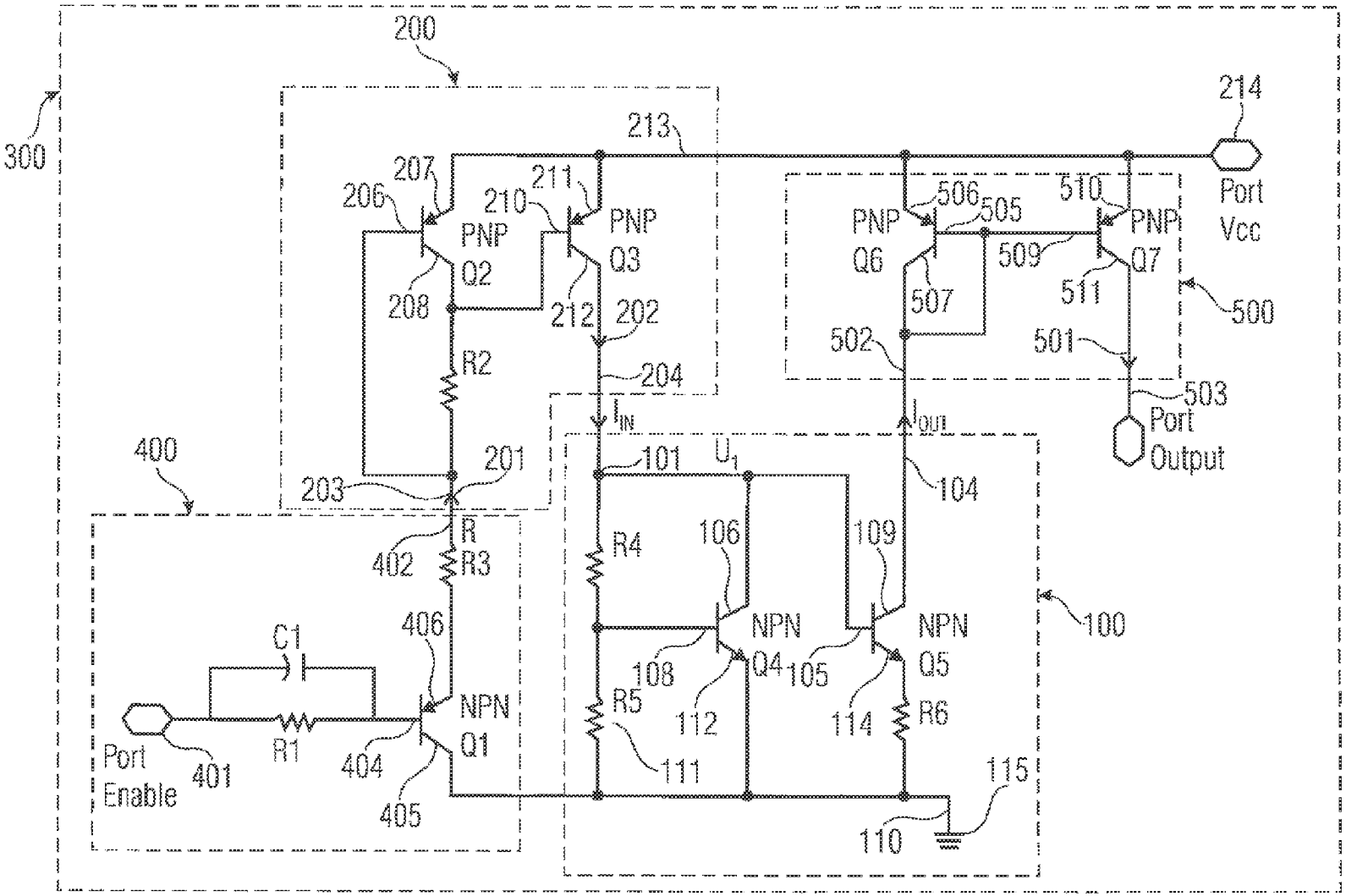
FIG. 3 shows a circuit diagram of low power bias circuit according to an embodiment of the invention.

FIG. 3 shows a circuit diagram of a low power bias circuit according to an embodiment of the invention. The low power bias circuit 300 comprises the peaking current mirror circuit 200 configured to receive a start current 201 and to provide a mirror current 202, a reference current circuit 100 as shown in FIG. 2, an optional enabling circuit 400 configured to provide the start current 201 and an optional Widlar current mirror 500 configured to receive the reference current Iout and to provide an output current 501.

The peaking current mirror circuit 200 may be a Nagata current mirror. The peaking current mirror circuit 200 comprises an input 203 configured to receive the start current 201 and an output 204 configured to provide the mirror current 202 as the input current Iin to the reference current circuit 100. The peaking current mirror circuit 200 further comprises a first PNP bipolar transistor Q2 having a base terminal 206, an emitter terminal 207 and a collector terminal 208, a second PNP bipolar transistor Q3 having a base terminal 210, an emitter terminal 211 and a collector terminal 212 with an area ratio of the two transistors Q3/Q1=M. The input 203 is directly connected to the base terminal 206 of the first PNP bipolar transistor Q2 and is connected via a resistor R2 to the collector terminal 208 of the first PNP bipolar transistor Q2 and the base terminal 210 of the second PNP bipolar transistor Q3. The output 204 is connected to the collector terminal 212 of the second PNP bipolar transistor Q3. A supply node 213 is connected to the emitter terminals 207, 211 of both PNP bipolar transistors Q2, Q3.

The reference current circuit 100 is adapted to compensate the temperature coefficient of the mirror current 202, wherein the temperature coefficient is represented by the thermal voltage $\phi T = kT/q$. The temperature coefficient of the mirror current 202 is approximately inverse proportional to a squared temperature. The reference current circuit 100 is adapted to compensate this temperature coefficient by applying a transformation with a squared temperature.

To provide the start current 201 for the peaking current mirror circuit 200 the low power bias circuit 300 comprises an enabling circuit 400 having an enabling line 401 configured to receive a logic enable signal. The enabling circuit 400 further comprises an output 402 configured to provide the start current 201. The enabling circuit 400 further comprises a NPN bipolar transistor Q1 having a base terminal 404, an emitter terminal 405 and a collector terminal 406. The enabling line 401 is connected via a parallel connection of a first resistor R1 and a capacitor C1 to the base terminal 404 of the NPN bipolar transistor Q1. The output 402 is connected via a second resistor R3 to the collector terminal 406 of the NPN bipolar transistor Q1. The emitter terminal 405 of the NPN bipolar transistor Q1 is connected to the reference potential 110. The bipolar transistor Q3 is configured to provide the start current 201 when the enabling line 401 receives the logic enable signal. The second resistor R3 is a start current setting resistor and is configured to set the start current 201.

One embodiment of the invention may comprise a Widlar current mirror. The optional Widlar current mirror 500 comprises an input 502 configured to receive the reference current Iout from the reference current circuit 100 and an output 503 configured to provide the output current 501. The output 503 may be connected to an output port. The Widlar current mirror 500 further comprises a first PNP bipolar transistor Q6 having a base terminal 505, an emitter terminal 506 and a collector terminal 507, and a second PNP bipolar transistor Q7 having a base terminal 509, an emitter terminal 510 and a collector terminal 511. The input 502 is connected to the collector terminal 507 of the first PNP bipolar transistor Q6, to the base terminal 505 of the PNP first bipolar transistor Q6 and to the base terminal 509 of the second PNP bipolar transistor Q7. The output 503 is connected to the collector terminal 511 of the second PNP bipolar transistor Q7. The supply node 213 is connected to the emitter terminal 506 of the first PNP bipolar transistor Q6 and to the emitter terminal 510 of the second PNP bipolar transistor Q7. The supply node 213 may be the same as the one for the peaking current mirror circuit 200 and may be connected to a supply voltage port 214 providing a predefined supply voltage Vcc.

The low power bias circuit 300 is configured to operate at supply voltages in the range of 1 V to 2 V. However, the low power bias circuit 300 may also operate with supply voltages above 2 V. The low power bias circuit 300 is designed to replace conventional bandgap circuits implemented in the same technology, e.g., using SiGe:C transistors and allows operation at voltages smaller than the voltage provided by a conventional bandgap circuit. The reference current circuit 100 is configured to provide a reference current Iout that is independent of the supply voltage and the reference voltage. The peaking current mirror circuit 200 offers a good supply rejection and the reference current mirror 100 is configured to compensate the temperature coefficient of the first one.

The following calculations will describe a possible approach for dimensioning the reference current circuit (temperature-compensating mirror 100) in FIG. 3. For the following calculations the currents that flow into the base terminals of the transistors are neglected. Further, ICQ2=collector current of Q2, ICQ3=collector current of Q3, ICQ4=collector current of Q4, ICQ5=collector current of Q5, ISQ2=saturation current of Q2, ISQ3=saturation current of Q3, ISQ4=saturation current of Q4, ISQ5=saturation current of Q5.

The input current of the temperature-compensating mirror is the collector current of transistor Q3 and is a function of the base-emitter voltage VBEQ3 and the temperature:

$$I_{CQ3} = I_{SQ3} e^{\frac{V_{BEQ3}}{\varphi_T}}, \tag{1}$$

where ISQ3 is the saturation current of Q3 and $\phi T = kT/q$ is the thermal voltage. Neglecting the base currents (for the sake of clarity):

$$I_{CQ2} = I_{SQ2} e^{\frac{V_{BEQ2}}{\varphi_T}} = \frac{I_{SQ3}}{M} e^{\frac{V_{BEQ3} + I_{CQ2} R2}{\varphi_T}} \tag{2}$$

Dividing (1) by (2) results in:

$$\frac{I_{CQ3}}{I_{CQ2}} = M e^{-\frac{I_{CQ2} R2}{\varphi_T}}. \tag{3}$$

The peak value is reached when $$\frac{dI_{CQ3}}{dI_{CQ2}} = \tag{4}$$

$$0 = M\left(e^{-\frac{I_{CQ2} R2}{\varphi_T}} - \frac{R2}{\varphi_T} I_{CQ2} e^{-\frac{I_{CQ2} R2}{\varphi_T}}\right) = M e^{-\frac{I_{CQ2} R2}{\varphi_T}}\left(1 - \frac{I_{CQ2} R2}{\varphi_T}\right)$$

or $$\frac{I_{CQ2} R2}{\varphi_T} = 1. \tag{5}$$

(5) can be used to calculate R2 for a given collector current:

$$R2 = \frac{\varphi_T}{I_{CQ2}}. \tag{6}$$

R3 can be calculated as follows:

$$R3 = \frac{V_{CC} - V_{BEQ2}}{I_{CQ2}} = \frac{R2(V_{CC} - V_{BEQ2})}{\varphi_T} \text{ where } V_{BEQ2} \approx 0.8 \text{ V}. \tag{7}$$

The temperature coefficient of ICQ3 is:

$$TCI_{CQ3} = \tag{8}$$

$$\frac{\frac{dI_{CQ3}}{dT}}{I_{CQ3}} = \frac{M I_{CQ2} e^{-\frac{I_{CQ2} R2}{\varphi_T}} \frac{d\left(-\frac{I_{CQ2} R2}{\varphi_T}\right)}{dT}}{M I_{CQ2} e^{-\frac{I_{CQ2} R2}{\varphi_T}}} = \frac{d\left(-\frac{(V_{CC} - V_{BEQ2}) R2}{\varphi_T R3}\right)}{dT}.$$

In case of TCR2 and TCR3=0:

$$TCI_{CQ3} = \frac{\frac{dI_{CQ3}}{dT}}{I_{CQ3}} = \frac{R2}{R3}\left(\frac{(V_{CC} - V_{BEQ2})}{kT^2/q} + \frac{dV_{BEQ2}}{dT\varphi_T}\right) \tag{9}$$

For U1, neglecting the base currents:

$$U_1 = I_{R4,R5}(R4 + R5) = \frac{V_{BEQ4}}{R5}(R4 + R5) = \varphi_T \ln\left(\frac{I_{CQ4}}{I_{SQ4}}\right)\frac{1}{R5}(R4 + R5). \tag{10}$$

But U1 also is:

$$U_1 = V_{BEQ5} + I_{CQ5} R6 = \varphi_T \ln\left(\frac{I_{CQ5}}{I_{SQ5}}\right) + I_{CQ5} R6 \tag{11}$$

or $$\ln\left(\frac{I_{CQ4}}{I_{SQ4}}\right)\frac{R4 + R5}{R5} = \ln\left(\frac{I_{CQ5}}{I_{SQ5}}\right) + \frac{I_{CQ5} R6}{\varphi_T}. \tag{12}$$

Differentiating both sides and assuming TCRs=0:

$$\frac{1}{I_{CQ4}}\frac{dI_{CQ4}}{dT}\frac{R4 + R5}{R5} = \frac{1}{I_{CQ5}}\frac{dI_{CQ5}}{dT} + \frac{R6}{\varphi_T}\left(\frac{dI_{CQ5}}{dT} - \frac{I_{CQ5}}{T}\right). \tag{13}$$

For full temperature compensations $$\frac{dI_{CQ5}}{dT} = 0$$

and TCICQ3≈TCICQ4:

$$-\frac{R2}{R3}(V_{CC} - 0.8 \text{ V}) = \frac{R5 R6}{R4 + R5} I_{CQ5}. \tag{14}$$

The calculated values can be used as a starting point for optimizing the circuit in a circuit simulator.

Figure 4:
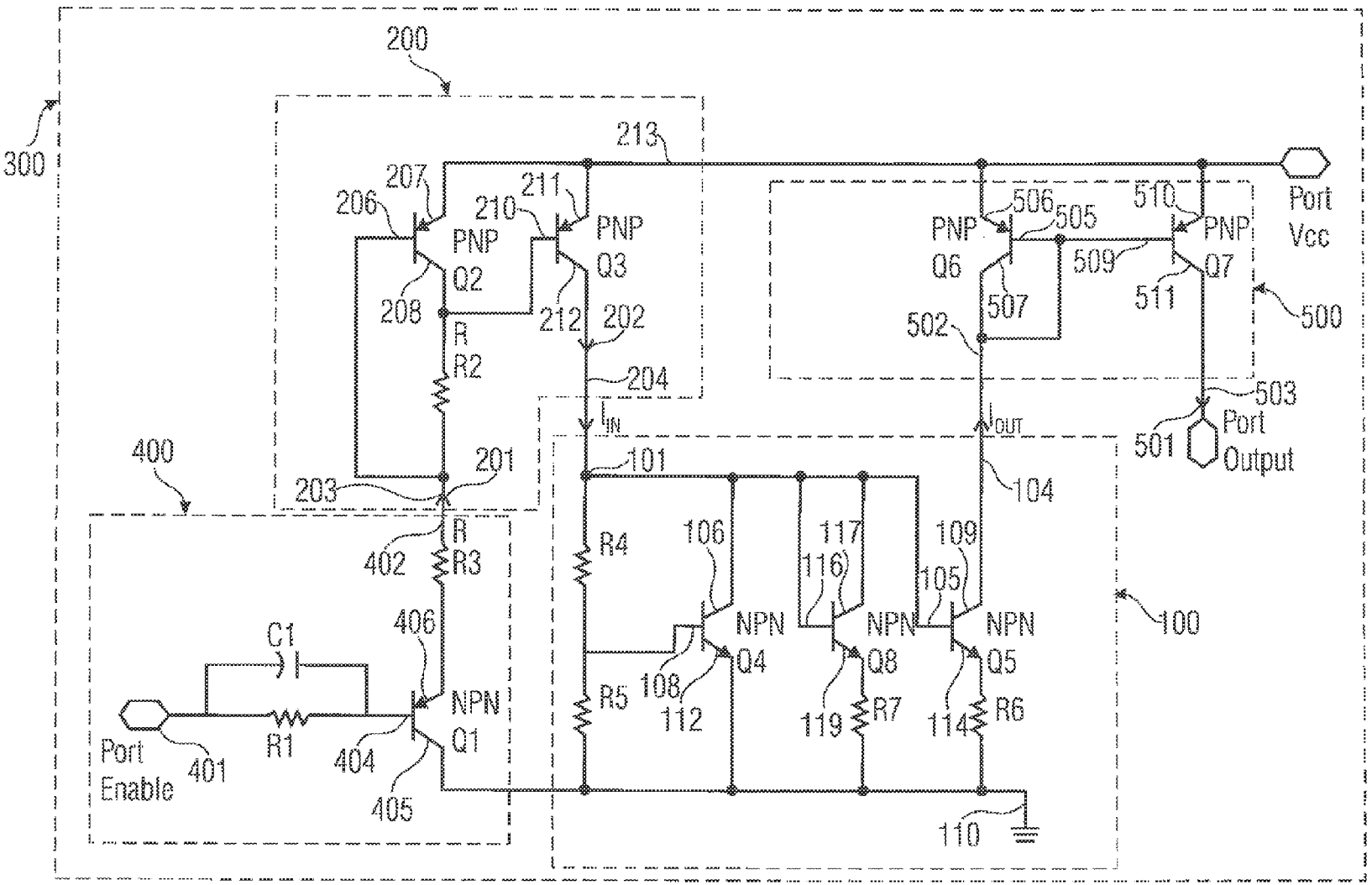
FIG. 4 shows circuit diagram of a low power bias circuit according to another embodiment of the invention.

FIG. 4 shows a circuit diagram of a low power bias circuit according to another embodiment of the invention. The low power bias circuit 300 according to FIG. 4 corresponds to the low power bias circuit 300 according to FIG. 3 except that the reference current circuit 100 was slightly modified by providing the additional NPN bipolar transistor Q8 which is connected in parallel to the first and second transistors Q4 and Q5. The base terminal 116 and the collector terminal 117 of the additional NPN bipolar transistor Q8 are connected to the input 101 of the reference current circuit 100, and the emitter terminal 119 of the additional NPN bipolar transistor Q8 is connected to the reference potential 110 via a further resistor R7. This embodiment is more robust against process variations of the semiconductor implementation.

Although embodiments of the invention were described on the basis of NPN bipolar transistors Q1, Q4, Q5, and Q8 and PNP bipolar transistors Q2, Q3, Q6 and Q7 for a negative logic the same functionality can be implemented by replacing the NPN transistors by PNP transistors and PNP transistors by NPN transistors.

Although embodiments of the invention were described on the basis of bipolar transistors, it is noted that the invention is not limited to such embodiments. Instead of bipolar transistors also MOSFETs, JFETs (junction field-effect transistors), MSFETs (metal semiconductor field-effect transistors), HEMTs (high electron mobility transistors), HSFETs (hetero structure FET), MODFETs (modulation-doped field-effect transistors), IGBTs (insulated gate bipolar transistors), HJBTs (hetero junction bipolar transistors) or other kinds of transistors may be used.

What is claimed is:

1. A low power bias circuit, comprising:

a peaking current mirror circuit configured to receive a start current and to provide a mirror current; and a temperature compensating current mirror coupled to the peaking current mirror circuit and configured to provide a reference current, wherein the temperature compensating current mirror comprises:

an input configured to receive the mirror current, a first bipolar transistor having a base terminal, an emitter terminal and a collector terminal, a second bipolar transistor having a base terminal, an emitter terminal and a collector terminal, and an output configured to provide the reference current, wherein the input is directly connected to the base terminal of the second bipolar transistor and the collector terminal of the first bipolar transistor, and is connected via a first resistor to the base terminal of the first bipolar transistor, wherein the output is connected to the collector terminal of the second bipolar transistor, and wherein a reference node providing a reference voltage is connected via a second resistor to the base terminal of the first bipolar transistor, directly to the emitter terminal of the first bipolar transistor and via a third resistor to the emitter terminal of the second bipolar transistor.

2. The low power bias circuit according to claim 1, wherein the temperature compensating current mirror comprises a third bipolar transistor having a base terminal, an emitter terminal and a collector terminal, wherein the input is directly connected to the base terminal and the collector terminal of the third bipolar transistor, and wherein the reference node is connected via a fourth resistor to the emitter terminal of the third bipolar transistor.

3. The low power bias circuit according to claim 1, further comprising:

an enabling circuit configured to provide the start current; and a Widlar current mirror configured to receive the reference current and to provide an output current.

4. The low power bias circuit according to claim 3, wherein the enabling circuit comprises:

an enabling line configured to receive a logic enable signal;

an output configured to provide the start current; and a bipolar transistor having a base terminal, an emitter terminal and a collector terminal, wherein the enabling line is connected via a parallel connection of a first resistor and a capacitor to the base terminal of the bipolar transistor, wherein the output is connected via a second resistor to the collector terminal of the bipolar transistor; wherein a reference node providing a reference voltage is connected to the emitter terminal of the bipolar transistor, and wherein the bipolar transistor is adapted to generate the start current when the enabling line receives the logic enable signal.

5. The low power bias circuit according to claim 3, wherein the Widlar current mirror comprises:

an input configured to receive the reference current;

an output configured to provide the output current;

a first bipolar transistor having a base terminal, an emitter terminal and a collector terminal; and a second bipolar transistor having a base terminal; an emitter terminal and a collector terminal, wherein the input is connected to the collector terminal and to the base terminal of the first bipolar transistor and to the base terminal of the second bipolar transistor, wherein the output is connected to the collector terminal of the second bipolar transistor, and wherein a supply node providing a supply voltage is connected to the emitter terminals of the first and second bipolar transistors.

6. The low power bias circuit according to claim 1, wherein the peaking current mirror circuit comprises a Nagata current mirror.

7. The low power bias circuit according to claim 1, wherein the mirror current has a temperature coefficient and wherein the reference current is temperature compensated.

8. The low power bias circuit according to claim 7, wherein the temperature coefficient is approximately inverse proportional to a squared temperature.

9. The low power bias circuit according to claim 1, wherein the peaking current mirror circuit comprises:

an input configured to receive the start current;

an output configured to provide the mirror current;

a first bipolar transistor having a base terminal, an emitter terminal and a collector terminal; and a second bipolar transistor having a base terminal, an emitter terminal and a collector terminal, wherein the input is directly connected to the base terminal of the first bipolar transistor and is connected via a resistor to the collector terminal of the first bipolar transistor and the base terminal of the second bipolar transistor, wherein the output is connected to the collector terminal of the second bipolar transistor, and wherein a supply node providing a supply voltage is connected to the emitter terminals of both the first and second bipolar transistors.

* * * * *